US011502438B2

(12) United States Patent
Wang et al.

(10) Patent No.: US 11,502,438 B2
(45) Date of Patent: Nov. 15, 2022

(54) POWER CONNECTOR AND POWER CONNECTOR ASSEMBLY

(71) Applicant: XFUSION DIGITAL TECHNOLOGIES CO., LTD., Zhengzhou (CN)

(72) Inventors: Feng Wang, Dongguan (CN); Kanghua Ou, Dongguan (CN); Yuguo Zhao, Shenzhen (CN)

(73) Assignee: XFUSION DIGITAL TECHNOLOGIES, CO., LTD., Zhengzhou (CN)

( * ) Notice: Subject to any disclaimer, the term of this patent is extended or adjusted under 35 U.S.C. 154(b) by 0 days.

(21) Appl. No.: 16/914,741

(22) Filed: Jun. 29, 2020

(65) Prior Publication Data

US 2020/0328547 A1 Oct. 15, 2020

Related U.S. Application Data

(63) Continuation of application No. PCT/CN2018/119364, filed on Dec. 5, 2018.

(30) Foreign Application Priority Data

Dec. 29, 2017 (CN) ..... 201711479556.3

(51) Int. Cl.
*H01R 13/193* (2006.01)
*H01R 24/60* (2011.01)

(52) U.S. Cl.
CPC ..... *H01R 13/193* (2013.01); *H01R 24/60* (2013.01)

(58) Field of Classification Search
CPC .... H01R 12/72; H01R 12/721; H01R 13/193; H01R 13/2457; H01R 13/2492; H01R 13/41; H01R 24/60
See application file for complete search history.

(56) References Cited

U.S. PATENT DOCUMENTS 1,477,527 A 12/1923 Bruno
3,631,381 A 12/1971 Pittman
4,298,237 A * 11/1981 Griffith ..... H01R 12/82 439/60

(Continued)

FOREIGN PATENT DOCUMENTS

CN 2281007 Y 5/1998
CN 101320075 A 12/2008

(Continued)

*Primary Examiner* — Oscar C Jimenez

(57) ABSTRACT

A power connector includes a housing and a clamp group disposed in the housing. An insertion opening is formed at one end of the housing, and the insertion opening is configured to plug in a plug. The clamp group includes an inner clamp and an outer clamp. An insertion slot is formed in the inner clamp, and the insertion slot is opposite to the insertion opening and is configured to accommodate a front end portion of the plug. The outer clamp is disposed to extend over the inner clamp. When the plug passes through the insertion opening and is plugged into the insertion slot, a contact end of the outer clamp close to the insertion opening presses against a conductive surface of the plug. A contact segment of the inner clamp also presses against the conductive surface of the plug.

11 Claims, 4 Drawing Sheets

(56) References Cited

U.S. PATENT DOCUMENTS

| | | | | |
|---|---|---|---|---|
| 4,560,221 | A * | 12/1985 | Olsson | H01R 12/89 439/260 |
| 4,904,197 | A | 2/1990 | Cabourne | |
| 8,425,237 | B2 * | 4/2013 | Sass | H01R 43/20 439/62 |
| 8,632,365 | B2 * | 1/2014 | Ngo | H01R 12/721 439/636 |
| 8,672,713 | B2 * | 3/2014 | Tajiri | H01R 12/585 439/630 |
| 9,196,986 | B2 * | 11/2015 | Tanaka | H01R 12/737 |
| 9,608,349 | B2 * | 3/2017 | Mashiyama | H01R 13/2457 |
| 10,637,175 | B1 * | 4/2020 | Zou | H01R 12/7088 |
| 2002/0022381 | A1 * | 2/2002 | Ito | H01R 12/721 439/60 |
| 2002/0119704 | A1 | 8/2002 | Ito et al. | |
| 2007/0197063 | A1 * | 8/2007 | Ngo | H01R 12/7088 439/108 |
| 2009/0209142 | A1 | 8/2009 | Sasaoka et al. | |
| 2013/0040482 | A1 * | 2/2013 | Ngo | H01R 12/7023 439/328 |
| 2016/0043494 | A1 | 2/2016 | Mashiyama et al. | |
| 2017/0373419 | A1 | 12/2017 | Lee | |
| 2018/0054010 | A1 | 2/2018 | Xu et al. | |
| 2018/0191093 | A1 * | 7/2018 | Phillips | H01R 13/516 |

FOREIGN PATENT DOCUMENTS

| | | | |
|---|---|---|---|
| CN | 203312506 | U | 11/2013 |
| CN | 105375145 | A | 3/2016 |
| CN | 205595515 | U | 9/2016 |
| CN | 106785543 | A | 5/2017 |
| CN | 206322919 | U | 7/2017 |
| CN | 108288788 | A | 7/2018 |
| EP | 1763111 | A2 | 3/2007 |
| JP | H10335019 | A | 12/1998 |
| TW | M548916 | U | 9/2017 |

* cited by examiner

POWER CONNECTOR AND POWER CONNECTOR ASSEMBLY

CROSS-REFERENCE TO RELATED APPLICATIONS

This application is a continuation of International Patent Application No. PCT/CN2018/119364, filed on Dec. 5, 2018, which claims priority to Chinese Patent Application No. 201711479556.3, filed on Dec. 29, 2017. The disclosures of the aforementioned applications are hereby incorporated by reference in their entirety.

TECHNICAL FIELD

This application relates to the field of power connection structure technologies, and in particular, to a power connector and a power connector assembly.

BACKGROUND

In an electronic circuit, a power connector assembly serves as a bridge to transmit an electric current from a power supply unit (for example, a battery) to each component in the circuit. With development of science and technology, an integration level of the electronic circuit is increasingly high. To meet power consumption requirements of more components in the electronic circuit, the electronic circuit requires the power connector assembly to be capable of transmitting a larger current.

For example, FIG. 1 shows a power connector assembly in the prior art. The power connector assembly includes a power connector 01 and a plug 02. The power connector 01 includes a housing 011 and a plurality of clamps 012 disposed in the housing 011. An insertion opening is formed at one end of the housing 011. As shown in FIG. 2 and FIG. 3, each clamp 012 includes two clamping pieces that are spaced and disposed opposite to each other, an insertion slot 013 is formed between the two clamping pieces, and the insertion slot 013 is opposite to the insertion opening. As shown in FIG. 1, the plug 02 includes a sheet-like substrate 021 and a plurality of pairs of contact patches 022 disposed on a side of the sheet-like substrate 021, the sheet-like substrate 021 is plug-connected in the insertion slot 013 through the insertion opening, and the plurality of pairs of contact patches 022 press against the plurality of clamps 012 one by one. In this way, one of the plug 02 and the power connector 01 may be connected to the power supply unit, and the other one is connected to a plurality of electrical components. The power supply unit is connected to the plurality of electrical components by plug-connecting the plug 02 to the power connector 01, to supply power to the plurality of electrical components.

To enable the power connector assembly shown in FIG. 1 to transmit a larger current, a width of a single clamp 012 or a quantity of the clamps 012 disposed in a width direction thereof may be increased in the prior art (as shown in FIG. 4), to increase contact areas or a quantity of contact points between the clamps 012 and the contact patches 022. However, when the width of the clamp 012 or the quantity of the clamps 012 is increased, as shown in FIG. 4, a width W of the housing 011 of the power connector 01 is correspondingly increased, thereby increasing a size of the power connector. This is not conducive to a small-sized design of an electronic device.

SUMMARY

Embodiments of this application provide a power connector and a power connector assembly, to improve a current transmitting capability of the power connector without increasing a size of the power connector.

To achieve the foregoing objective, the following technical solutions are used in the embodiments of this application.

According to one aspect, an embodiment of this application provides a power connector. The power connector includes a housing and a clamp group disposed in the housing. An insertion opening is formed at one end of the housing, and the insertion opening is configured to plug in a plug. The clamp group includes an inner clamp and an outer clamp. An insertion slot is formed in the inner clamp, and the insertion slot is opposite to the insertion opening and is configured to accommodate a front end portion of the plug. The outer clamp extends over the inner clamp, and one end that is of the outer clamp and that is close to the insertion opening extends to between the inner clamp and the insertion opening. When the plug passes through the insertion opening and is plugged into the insertion slot, one end that is of the outer clamp and that is close to the insertion opening and the inner clamp press against a conductive surface of the plug.

The power connector provided in this embodiment of this application includes the housing and the clamp group disposed in the housing, the insertion opening is formed at one end of the housing, the insertion opening is configured to plug in the plug, the clamp group includes the inner clamp and the outer clamp, the insertion slot is formed in the inner clamp, the insertion slot is opposite to the insertion opening and is configured to accommodate the front end portion of the plug, the outer clamp extends over the inner clamp, one end that is of the outer clamp and that is close to the insertion opening extends to between the inner clamp and the insertion opening, and when the plug passes through the insertion opening and is plugged into the insertion slot, one end that is of the outer clamp and that is close to the insertion opening and the inner clamp press against the conductive surface of the plug. Therefore, compared with the common art, in the power connector in this embodiment of this application, a quantity of contact points between one clamp group and the plug can at least double, and a width of the housing of the power connector can be kept basically unchanged. Based on this, a current transmitting capability of the power connector is improved without increasing a size of the power connector.

Optionally, there are a plurality of outer clamps. The plurality of outer clamps sequentially extend over the inner clamp from inside to outside, and one end that is of an outer-side outer clamp in two adjacent outer clamps and that is close to the insertion opening extends to between an inner-side outer clamp in the two adjacent outer clamps and the insertion opening. When the plug passes through the insertion opening and is plugged into the insertion slot, one end that is of each of the plurality of outer clamps and that is close to the insertion opening presses against the conductive surface of the plug. In this way, the quantity of the contact points between one clamp group and the plug is further increased, thereby further improving the current transmitting capability of the power connector. A quantity of the outer clamps is two, three, four, or the like, which is not specifically limited herein.

Optionally, there is one outer clamp. Therefore, the quantity of the outer clamps is appropriate, which facilitates installation in the housing with limited space.

Optionally, the inner clamp includes two inner clamping pieces that are spaced and disposed opposite to each other, the outer clamp includes two outer clamping pieces that are spaced and disposed opposite to each other, the insertion slot is formed between the two inner clamping pieces, and the two outer clamping pieces are respectively disposed on outer sides of the two inner clamping pieces. The inner clamp and the outer clamp of this structure are simple in structure and easy to manufacture.

Optionally, the outer clamping piece includes a supporting arm, a first flexible arm, and a first contact segment. The supporting arm extends in an insertion direction of the insertion slot. The first flexible arm is formed by reversely bending one end that is of the supporting arm and that is close to the insertion opening towards an inner side of the insertion slot and extending the end in a direction away from the insertion opening. The first contact segment is disposed at one end that is of the first flexible arm and that is away from the insertion opening. One end that is of the supporting arm and that is away from the insertion opening is fastened in the housing. The first contact segment is configured to press against the conductive surface of the plug. In this way, a plug connection channel with a width gradually decreasing in the insertion direction of the insertion slot is formed between the first flexible arms on two outer clamping pieces that are oppositely disposed, so that the plug can be more easily plugged into the insertion slot.

Optionally, the inner clamping piece includes a second flexible arm and a second contact segment. The second flexible arm extends in an insertion direction of the insertion slot. The second contact segment is disposed at one end that is of the second flexible arm and that is close to the insertion opening. One end that is of the second flexible arm and that is away from the insertion opening is fastened in the housing. The second contact segment is configured to press against the conductive surface of the plug. In this way, a length of the inner clamping piece in the insertion direction of the insertion slot is relatively short, which can reduce material costs of the inner clamp.

Optionally, there are a plurality of clamp groups, and the plurality of clamp groups are spaced in a width direction of the inner clamping piece. In this way, the plurality of clamp groups press against the conductive surface of the plug to further increase the quantity of the contact points, thereby further improving the current transmitting capability of the power connector.

Optionally, a heat dissipation hole is disposed on a surface of the housing, and the heat dissipation hole communicates an inner side and an outer side of the housing. In this way, heat in the housing can be dissipated by using the heat dissipation hole, to improve a passive heat dissipation capability and the current transmitting capability of the power connector.

Optionally, there are a plurality of heat dissipation holes, and the plurality of heat dissipation holes are evenly disposed on the surface of the housing. In this way, more heat can be dissipated by using the plurality of heat dissipation holes, to further improve the passive heat dissipation capability and the current transmitting capability of the power connector.

Optionally, the housing includes a tubular housing body and a fastening base. A pipe opening at one end of the tubular housing body is the insertion opening, the fastening base is detachably connected to the inside of a pipe opening at the other end of the tubular housing body, and the clamp group is fastened on the fastening base. In this way, the clamp group can be fastened on the fastening base, and then the fastening base is connected to the inside of the tubular housing body, so that there is no need to install the clamp group in the housing with limited space. Therefore, an installation process of the clamp group is simplified.

According to another aspect, an embodiment of this application provides a power connector assembly. The power connector assembly includes a power connector and a plug. The power connector is the power connector according to any one of the foregoing technical solutions, and the plug passes through an insertion opening of the power connector and is plugged into an insertion slot in the power connector.

According to the power connector assembly provided in this embodiment of this application, the power connector in the power connector assembly is the power connector according to any one of the foregoing solutions, and includes a housing and a clamp group disposed in the housing, an insertion opening is formed at one end of the housing, the insertion opening is configured to plug in a plug, the clamp group includes an inner clamp and an outer clamp, an insertion slot is formed in the inner clamp, the insertion slot is opposite to the insertion opening and is configured to accommodate a front end portion of the plug, the outer clamp extends over the inner clamp, one end that is of the outer clamp and that is close to the insertion opening extends to between the inner clamp and the insertion opening, and when the plug passes through the insertion opening and is plugged into the insertion slot, one end that is of the outer clamp and that is close to the insertion opening and the inner clamp press against a conductive surface of the plug. Therefore, compared with the prior art, in the power connector assembly in this embodiment of this application, a quantity of contact points between the power connector and the plug can at least double, and a width of the housing of the power connector can be kept basically unchanged. Based on this, a current transmitting capability of the power connector is improved without increasing a size of the power connector.

BRIEF DESCRIPTION OF DRAWINGS

The following briefly describes accompanying drawings required for describing embodiments or the prior art.

DESCRIPTION OF EMBODIMENTS

The following describes the technical solutions in the embodiments of this application with reference to the accompanying drawings in the embodiments of this application.

In descriptions of this application, it should be understood that a direction or a position relationship indicated by terms such as "center", "upper", "lower", "front", "back", "left", "right", "vertical", "horizontal", "top", "bottom", "inside", or "outside" is a direction or a position relationship shown based on the accompanying drawings, is merely used to facilitate descriptions of this application and simplify the descriptions, but is not intended to indicate or imply that an indicated apparatus or element needs to have a particular direction, and needs to be constructed and operated in a particular direction, and therefore cannot be construed as a limitation on this application.

Figure 1:
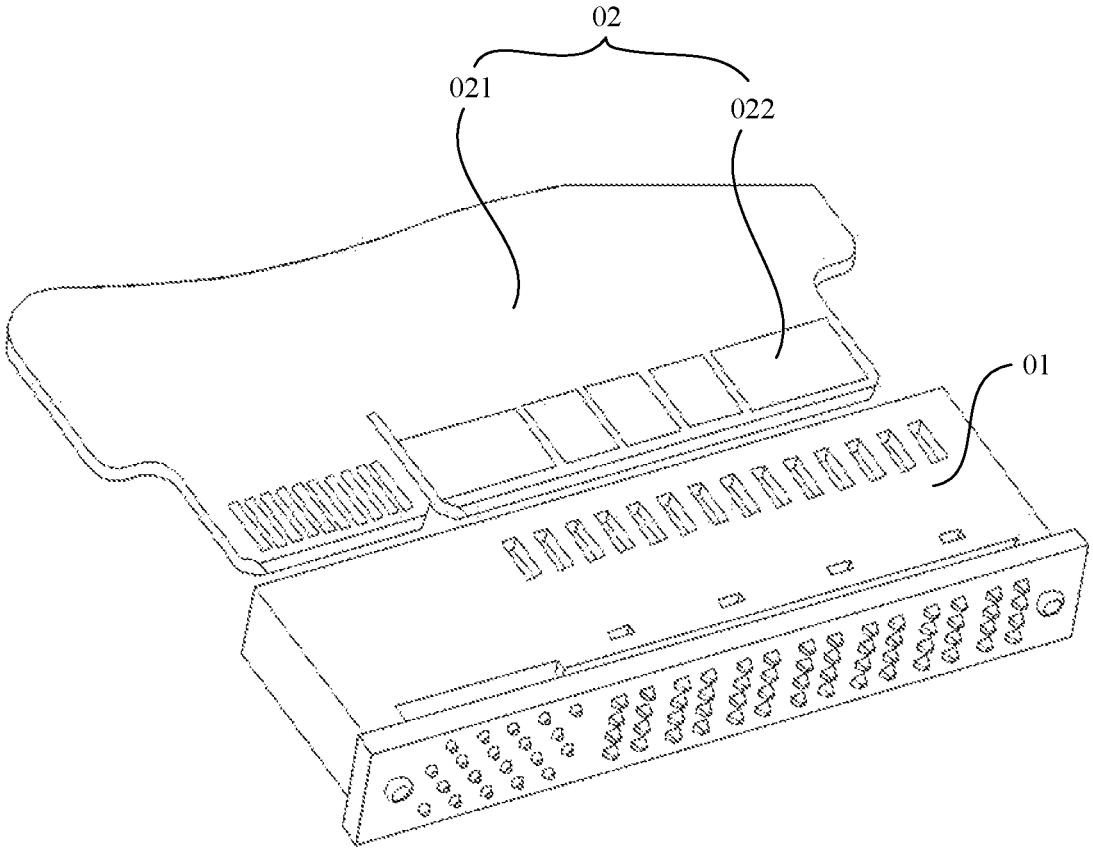
FIG. 1 (Prior Art)
FIG. 1 is a schematic diagram of a structure of a power connector assembly in the prior art.
Figure 2:
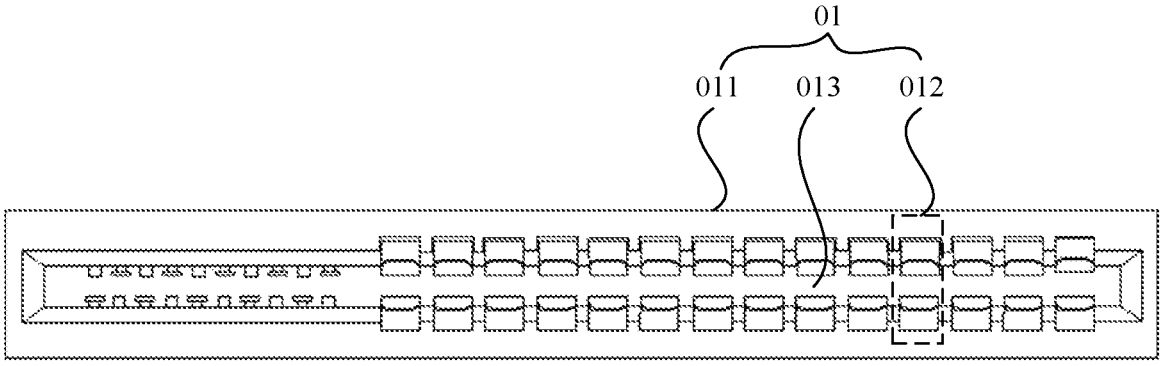
FIG. 2(Prior Art)
FIG. 2 is a schematic diagram of a first structure of an end face of an insertion opening end of a power connector in the power connector assembly shown in FIG. 1.
Figure 3:
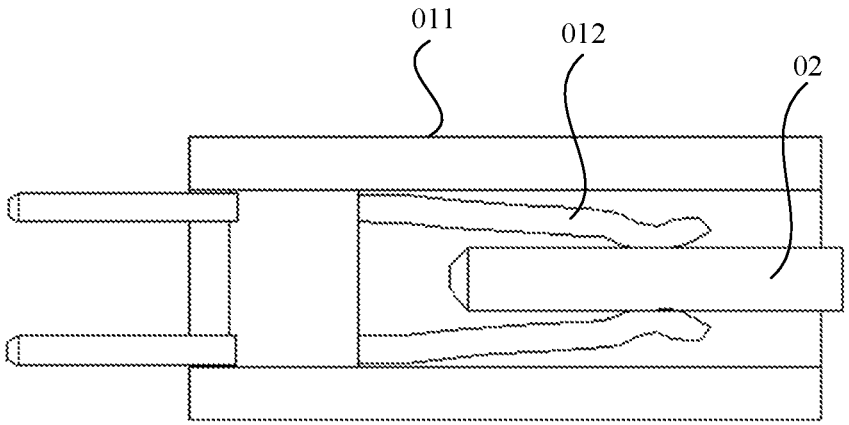
FIG. 3 (Prior Art)
FIG. 3 is a schematic diagram of a structure of a cross section of the power connector assembly shown in FIG. 1.
Figure 4:
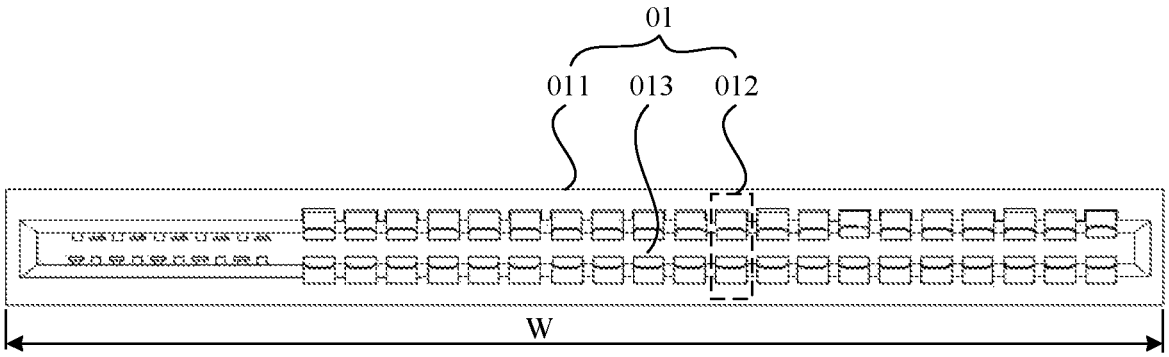
FIG. 4 (Prior Art)
FIG. 4 is a schematic diagram of a second structure of an end face of an insertion opening end of a power connector in the power connector assembly shown in FIG. 1.
Figure 5:
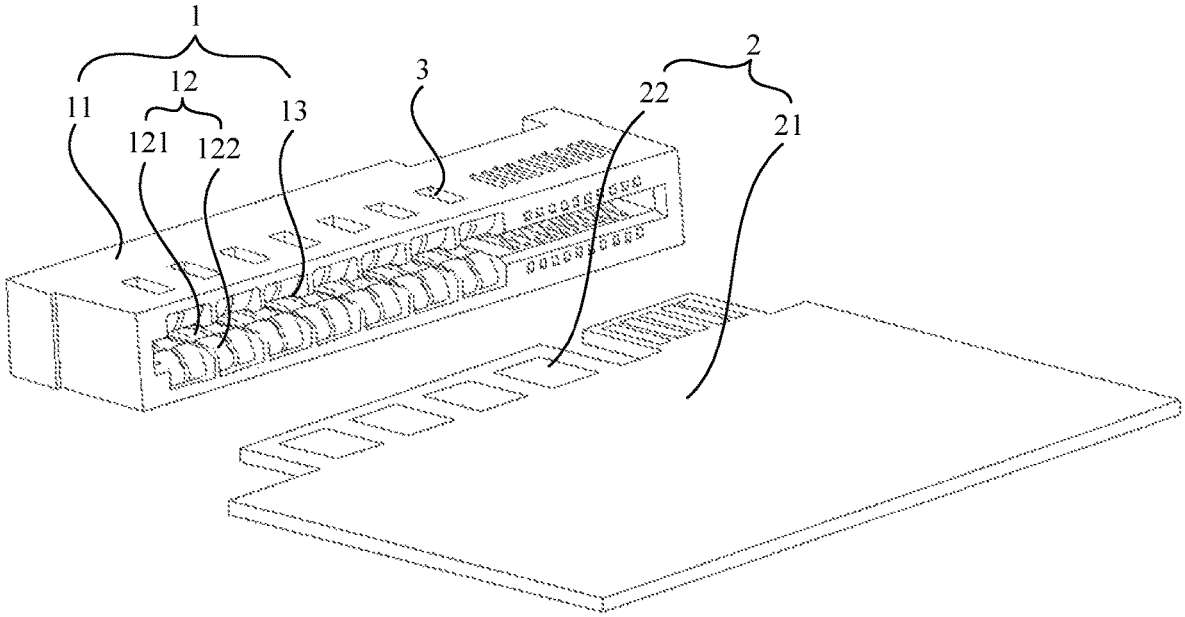
FIG. 5 is a schematic diagram of a structure of a power connector assembly according to an embodiment of this application.

Referring to FIG. 5, an embodiment of this application provides a power connector assembly. The power connector assembly in this embodiment of this application includes a power connector 1 and a plug 2. The plug 2 passes through an insertion opening of the power connector 1 and then is plugged into an insertion slot in the power connector 1.

Figure 6:
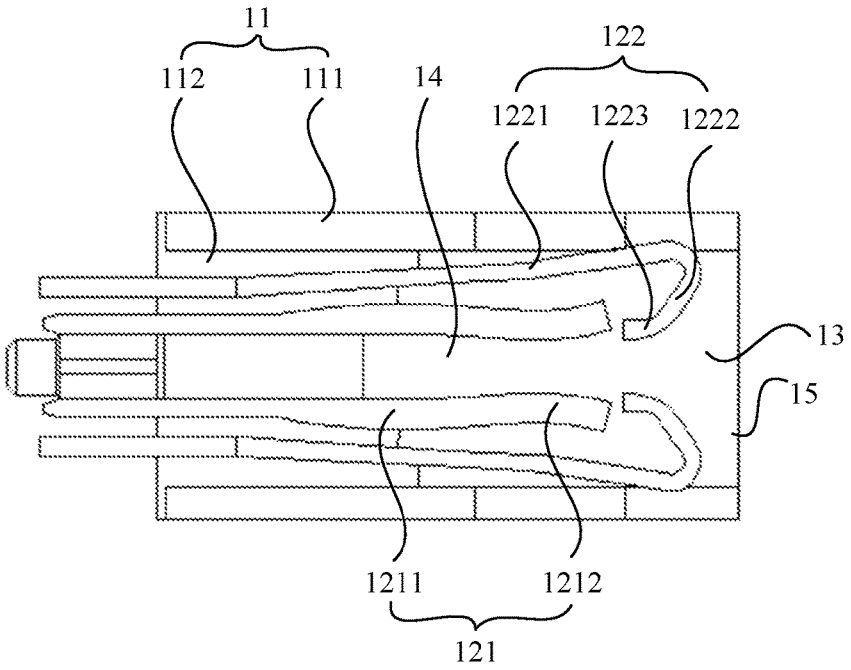
FIG. 6 is a schematic diagram of a structure of a first cross section of a power connector according to an embodiment of this application.

In the foregoing embodiment, as shown in FIG. 5, the power connector 1 includes a housing 11 and a clamp group 12 disposed in the housing 11. An insertion opening 13 is formed at one end of the housing 11, and the insertion opening 13 is configured to plug in a plug 2. The clamp group 12 includes an inner clamp 121 and an outer clamp 122. As shown in FIG. 6, an insertion slot 14 is formed in the inner clamp 121, and the insertion slot 14 is opposite to the insertion opening 13 and is configured to accommodate a front end portion of the plug 2.

The outer clamp 122 extends over the inner clamp 121, and one end that is of the outer clamp 122 and that is close to the insertion opening 13 extends to between the inner clamp 121 and the insertion opening 13. When the plug 2 passes through the insertion opening 13 and is plugged into the insertion slot 14, one end that is of the outer clamp 122 and that is close to the insertion opening 13 and the inner clamp 121 press against a conductive surface of the plug 2.

The power connector 1 provided in this embodiment of this application includes the housing 11 and the clamp group 12 disposed in the housing 11. The insertion opening 13 is formed at one end of the housing 11, the insertion opening 13 is configured to receive the plug 2. The clamp group 12 includes the inner clamp 121 and the outer clamp 122. The insertion slot 14 is formed in the inner clamp 121, the insertion slot 14 is opposite to the insertion opening 13 and is configured to accommodate the front end portion of the plug 2. The outer clamp 122 extends over the surface of the inner clamp 121, one end that is of the outer clamp 122 and that is close to the insertion opening 13 extends to between the inner clamp 121 and the insertion opening 13. And when the plug 2 passes through the insertion opening 13 and is plugged into the insertion slot 14, one end that is of the outer clamp 122 and that is close to the insertion opening 13 and the inner clamp 121 press against the conductive surface of the plug 2. Therefore, compared with the prior art, in the power connector in this embodiment of this application, a quantity of contact points between one clamp group 12 and the plug 2 can at least double, and a width of the housing 11 of the power connector 1 can be kept basically unchanged. Based on this, a current transmitting capability of the power connector is improved without increasing a size of the power connector.

According to the power connector assembly provided in this embodiment of this application, the power connector 1 in the power connector assembly is the power connector according to any one of the foregoing solutions, and includes the housing 11 and the clamp group 12 disposed in the housing 11, the insertion opening 13 is formed at one end of the housing 11, the insertion opening 13 is configured to plug in the plug 2, the clamp group 12 includes the inner clamp 121 and the outer clamp 122, the insertion slot 14 is formed in the inner clamp 121, the insertion slot 14 is opposite to the insertion opening 13 and is configured to accommodate the front end portion of the plug 2, the outer clamp 122 extends over the surface of the inner clamp 121, one end that is of the outer clamp 122 and that is close to the insertion opening 13 extends to between the inner clamp 121 and the insertion opening 13. And when the plug 2 passes through the insertion opening 13 and is plugged into the insertion slot 14, one end that is of the outer clamp 122 and that is close to the insertion opening 13 and the inner clamp 121 press against the conductive surface of the plug 2. Therefore, compared with the prior art, in the power connector assembly in this embodiment of this application, the quantity of the contact points between the power connector 1 and the plug 2 can at least double, and the width of the housing 11 of the power connector 1 can be kept basically unchanged. Based on this, the current transmitting capability of the power connector is improved without increasing the size of the power connector.

In the foregoing embodiment, the housing 11 may be of a cylindrical shape, a square columnar shape, a spherical shape, or the like. This is not specifically limited herein. For example, as shown in FIG. 5, the housing 11 is of a square columnar shape.

Structures of the outer clamp 122 and the inner clamp 121 are not specifically limited, as long as the insertion slot 14 can be formed and the plug 2 is clamped by using the conductive surfaces of the plug 2.

In addition, to make the plug 2 closely fit the insertion opening 13, a shape of a cross section of the plug 2 needs to match a shape of the insertion opening 13. In this embodiment of this application, the insertion opening 13 may be of a circular shape, a rectangular shape, a square shape, or the like, which is not specifically limited herein. Correspondingly, the cross section of the plug 2 may be of a circular shape, a rectangular shape, a square shape, or the like, which is not specifically limited herein. For example, as shown in FIG. 5, the insertion opening 13 is of a rectangular shape, and the cross section of the plug 2 is of a rectangular shape, in other words, the plug 2 is sheet-like.

Further, a structure of the plug is not specifically limited. For example, as shown in FIG. 5, the plug 2 includes a pin base 21 and a contact patch 22 disposed on a surface of the pin base 21, the pin base 21 passes through the insertion opening 13 and is plugged into the insertion slot 14, the contact patches 22 presses against both one end of the inner clamp 121 and one end of the outer clamp 122 that are close to the insertion opening.

Further, there may be one or more outer clamps 122, which is not specifically limited herein.

Figure 7:
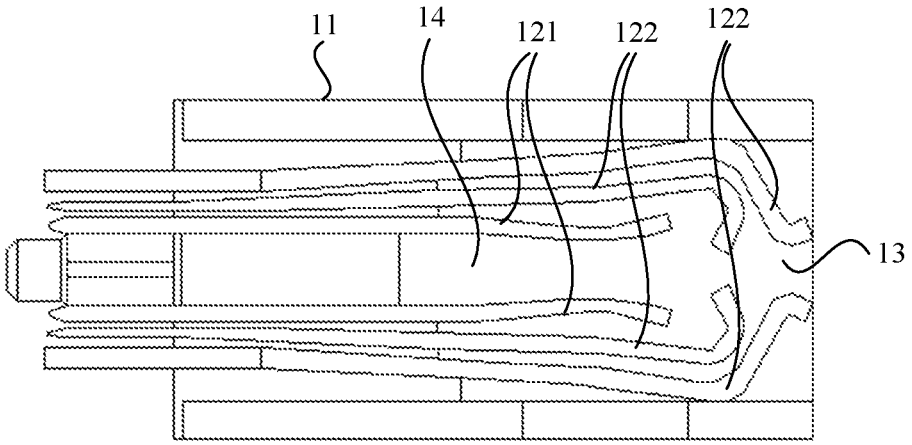
FIG. 7 is a schematic diagram of a structure of a second cross section of a power connector according to an embodiment of this application.

Optionally, as shown in FIG. 7, there are a plurality of outer clamps 122. The plurality of outer clamps 122 extend over the surface of the inner clamp 121 from inside to outside, and one end that is of an outer-side outer clamp 122 in two adjacent outer clamps 122 and that is close to the insertion opening 13 extends to between an inner-side outer clamp 122 in the two adjacent outer clamps 122 and the insertion opening 13. When the plug passes through the insertion opening 13 and is plugged into the insertion slot 14, one end that is of each of the plurality of outer clamps 122 and that is close to the insertion opening 13 presses against the conductive surface of the plug. In this way, the quantity of the contact points between one clamp group 12 and the plug is further increased, thereby further improving the current transmitting capability of the power connector. The quantity of the outer clamps 122 may be two, three, four, or the like, which is not specifically limited herein. For example, there are two outer clamps 122, as shown in FIG. 7.

Figure 8:
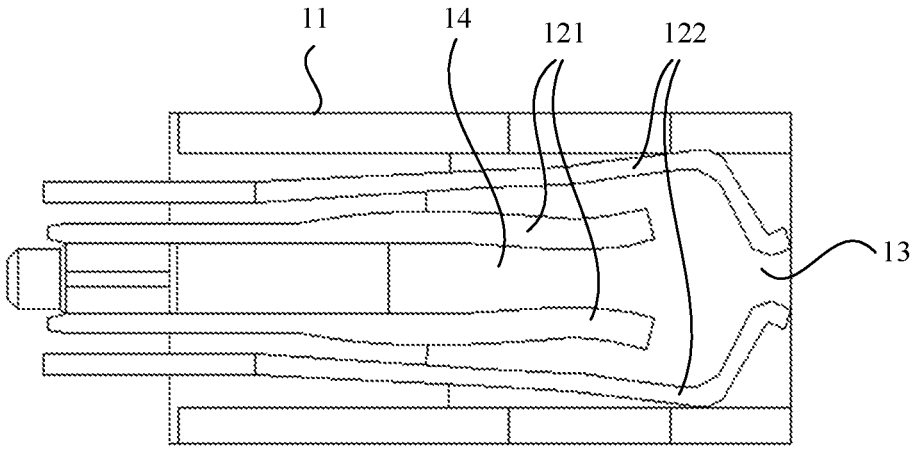
FIG. 8 is a schematic diagram of a structure of a third cross section of a power connector according to an embodiment of this application.

Optionally, as shown in FIG. 6 and FIG. 8, there is one outer clamp 122. Therefore, the quantity of the outer clamps 122 is appropriate, which facilitates installation in the housing 11 with limited space.

In the embodiment shown in FIG. 5, optionally, as shown in FIG. 6, FIG. 7 and FIG. 8, the inner clamp 121 includes two inner clamping pieces that are spaced and disposed opposite to each other, the outer clamp 122 includes two outer clamping pieces that are spaced and disposed opposite to each other, the insertion slot 14 is formed between the two inner clamping pieces, and the two outer clamping pieces are respectively disposed on outer sides of the two inner clamping pieces. The inner clamp 121 and the outer clamp 122 of this structure are simple in structure and easy to manufacture.

The outer clamping piece may be manufactured into a structure shown in FIG. 6, or may be manufactured into a structure shown in FIG. 8, which is not specifically limited herein. Optionally, as shown in FIG. 6, the outer clamping piece includes a supporting arm 1221, a first flexible arm 1222, and a first contact segment 1223. The supporting arm 1221 extends in an insertion direction of the insertion slot 14. The first flexible arm 1222 is formed by reversely bending one end that is of the supporting arm 1221 and that is close to the insertion opening 13 towards an inner side of the insertion slot 14 and extending the end in a direction away from the insertion opening 13. The first contact segment 1223 is disposed at one end that is of the first flexible arm 1222 and that is away from the insertion opening 13. One end that is of the supporting arm 1221 and that is away from the insertion opening 13 is fastened in the housing 11. The first contact segment 1223 is configured to press against the conductive surface of the plug. In this way, a plug connection channel with a width gradually decreasing in the insertion direction of the insertion slot 14 is formed between the first flexible arms 1222 on two outer clamping pieces that are oppositely disposed, so that the plug can be more easily plugged into the insertion slot 14.

In addition, a specific structure of the inner clamping piece is not limited. Optionally, as shown in FIG. 6, the inner clamping piece includes a second flexible arm 1211 and a second contact segment 1212. The second flexible arm 1211 extends in an insertion direction of the insertion slot 14. The second contact segment 1212 is disposed at one end that is of the second flexible arm 1211 and that is close to the insertion opening 13. One end that is of the second flexible arm 1211 and that is away from the insertion opening 13 is fastened in the housing 11. The second contact segment 1212 is configured to press against the conductive surface of the plug. In this way, a length of the inner clamping piece in the insertion direction of the insertion slot 14 is relatively short, which can reduce material costs of the inner clamp 121.

Optionally, as shown in FIG. 5, there are a plurality of clamp groups 12, and the plurality of clamp groups 12 are spaced in a width direction of the inner clamping piece. In this way, the plurality of clamp groups 12 press against the conductive surface of the plug 2 to further increase the quantity of the contact points, and therefore this further improves the current transmitting capability of the power connector.

Optionally, as shown in FIG. 5, a heat dissipation hole 3 is disposed on a surface of the housing 11, and the heat dissipation hole 3 communicates an inner side and an outer side of the housing 11. In this way, heat in the housing 11 can be dissipated by using the heat dissipation hole 3, to improve a passive heat dissipation capability and the current transmitting capability of the power connector.

The heat dissipation hole 3 may be a circular hole, a square hole, a triangular hole, or the like. This is not specifically limited herein. For example, the heat dissipation hole 3 is a rectangular hole shown in FIG. 5.

In addition, optionally, as shown in FIG. 5, there are a plurality of heat dissipation holes 3, and the plurality of heat dissipation holes 3 are evenly disposed on the surface of the housing 11. In this way, more heat can be dissipated by using the plurality of heat dissipation holes 3, to further improve the passive heat dissipation capability and the current transmitting capability of the power connector.

Optionally, as shown in FIG. 6, the housing 11 includes a tubular housing body 111 and a fastening base 112. A pipe opening 15 at one end of the tubular housing body 111 is the insertion opening 13, the fastening base 112 is detachably connected to the inside of a pipe opening at the other end of the tubular housing body 111, and the clamp group 12 is fastened on the fastening base 112. In this way, the clamp group 12 can be fastened on the fastening base 112, and then the fastening base 112 is connected to the inside of the tubular housing body 111, so that the clamp group 12 does not need to be installed in the housing 11 with limited space. Therefore, an installation process of the clamp group 12 is simplified.

In the foregoing embodiment, the fastening base 112 may be detachably connected to the inside of the pipe opening of the tubular housing body 111 by using a fastener structure, or may be detachably connected to the pipe opening of the tubular housing body 111 by using a threaded connection structure. This is not specifically limited herein.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A power connector, comprising:

a housing; and a clamp group disposed in the housing, wherein an insertion opening is formed at one end of the housing configured to receive a plug, the clamp group comprises an inner clamp, a first outer clamp, and a second outer clamp on an outer-side of the first outer clamp, an insertion slot is formed in the inner clamp, the insertion slot is opposite to the insertion opening and configured to accommodate a front end portion of the plug, and the first outer clamp extends over the inner clamp, a contact segment of the second outer clamp is bent toward the insertion opening; and when the plug passes through the insertion opening and is plugged into the insertion slot, an end of the first outer clamp close to the insertion opening is configured to press against a conductive surface of the plug, a contact segment of the inner clamp is configured to press against the conductive surface of the plug, and the contact segment of the second outer clamp is configured to press against the conductive surface of the plug;

wherein the housing comprises a housing body of a preset shape and a fastening base, a pipe opening at one end of the housing body of the preset shape forms the insertion opening, the fastening base is detachably connected to the inside of the pipe opening at the other end of the housing body of the preset shape, and the clamp group is fastened on the fastening base;

wherein a plurality of heat dissipation holes are evenly disposed on a surface of the housing to connect an inner side and an outer side of the housing, wherein the inner clamp comprises two inner clamping pieces that are spaced and disposed opposite to each other, the first outer clamp comprises two first outer clamping pieces that are spaced and disposed opposite to each other, and the second outer clamp comprises two second outer claiming pieces disposed opposite to each other, and the insertion slot is formed between the two inner clamping pieces, and wherein the end of the first outer clamp close to the insertion opening is turned in a direction towards the insertion slot and away from the insertion opening, and an end of the second outer clamp close to the insertion opening is turned in a direction towards the insertion opening.

2. The power connector according to claim 1, wherein the inner clamp extends in a direction towards the insertion slot.

3. The power connector according to claim 1, wherein the end of the second outer clamp close to the insertion opening extends in a direction towards the insertion opening.

4. The power connector according to claim 1, wherein each of the first outer clamping pieces comprises a supporting arm, a first flexible arm, and a first contact segment, the supporting arm extends in an insertion direction of the insertion slot, the first flexible arm is formed by reversely bending one end that is of the supporting arm and that is close to the insertion opening towards an inner side of the insertion slot and extending the end in a direction away from the insertion opening, the first contact segment is disposed at one end that is of the first flexible arm and that is away from the insertion opening, one end that is of the supporting arm and that is away from the insertion opening is fastened in the housing, and the first contact segment is configured to press against the conductive surface of the plug.

5. The power connector according to claim 1, wherein each of the inner clamping piece comprises a second flexible arm and a second contact segment, the second flexible arm extends in an insertion direction of the insertion slot, the second contact segment is disposed at one end that is of the second flexible arm and that is close to the insertion opening, one end that is of the second flexible arm and that is away from the insertion opening is fastened in the housing, and the second contact segment is configured to press against the conductive surface of the plug.

6. The power connector according to claim 1, wherein each of the first outer clamping pieces comprises a supporting arm and a first contact segment, the supporting arm extends in an insertion direction of the insertion slot, and the first contact segment is disposed at one end that is of a first flexible arm and that is away from the insertion opening, one end that is of the supporting arm and that is away from the insertion opening is fastened in the housing, and the first contact segment is configured to press against the conductive surface of the plug.

7. The power connector according to claim 1, wherein the power connector comprises a plurality of clamp groups spaced in a width direction of the connector.

8. The power connector according to claim 1, wherein the preset shape is a tubular shape, a cylindrical shape, or a bucket shape.

9. The power connector according to claim 1, wherein the end of the first outer clamp close to the insertion opening is configured to press against a conductive surface of the plug includes a tip of the first outer clamp close to the insertion opening.

10. A power connector assembly, comprising:

a power connector; and a plug having a conductive surface, wherein the power connector comprises a housing and a clamp group disposed in the housing, an insertion opening is formed at one end of the housing, the insertion opening is configured to receive the plug, the clamp group comprises an inner clamp, a first outer clamp, and a second outer clamp on an outer-side of the first outer clamp, an insertion slot is formed in the inner clamp and opposite to the insertion opening and is configured to accommodate a front end portion of the plug, and the first outer clamp extends over the inner clamp, wherein a contact segment of the second outer clamp is bent toward the insertion opening;

when the plug passes through the insertion opening and is plugged into the insertion slot, an end of the first outer clamp close to the insertion opening is configured to press against the conductive surface of the plug, a contact segment of the inner clamp is configured to press against the conductive surface of the plug, and the contact segment of the second outer clamp is configured to press against the conductive surface of the plug;

wherein the housing comprises a housing body of a preset shape and a fastening base, a pipe opening at one end of the housing body of the preset shape forms the insertion opening, the fastening base is detachably connected to the inside of the pipe opening at the other end of the housing body of the preset shape, and the clamp group is fastened on the fastening base; and wherein a plurality of heat dissipation holes are evenly disposed on a surface of the housing to connect an inner side and an outer side of the housing, wherein the inner clamp comprises two inner clamping pieces that are spaced and disposed opposite to each other, the first outer clamp comprises two first outer clamping pieces that are spaced and disposed opposite to each other, and the second outer clamp comprises two second outer claiming pieces disposed opposite to each other, and the insertion slot is formed between the two inner clamping pieces, and wherein the end of the first outer clamp close to the insertion opening is turned in a direction towards the insertion slot and away from the insertion opening, and an end of the second outer clamp close to the insertion opening is turned in a direction towards the insertion opening.

11. A power connector, comprising:

a housing; and a clamp group disposed in the housing, wherein an insertion opening is formed at one end of the housing configured to receive a plug, the clamp group comprises an inner clamp, a first outer clamp, and a second outer clamp on an outer-side of the first outer clamp, an insertion slot is formed in the inner clamp, the insertion slot is opposite to the insertion opening and configured to accommodate a front end portion of the plug, and the first outer clamp extends over the inner clamp, a contact segment of the second outer clamp is bent toward the insertion opening; and when the plug passes through the insertion opening and is plugged into the insertion slot, an end of the first outer clamp close to the insertion opening is configured to press against a conductive surface of the plug, a contact segment of the inner clamp is configured to press against the conductive surface of the plug, and the contact segment of the second outer clamp is configured to press against the conductive surface of the plug:

wherein the housing comprises a housing body of a preset shape and a fastening base, a pipe opening at one end of the housing body of the preset shape forms the insertion opening, the fastening base is detachably connected to the inside of the pipe opening at the other end of the housing body of the preset shape, and the clamp group is fastened on the fastening base:

wherein a plurality of heat dissipation holes are evenly disposed on a surface of the housing to connect an inner side and an outer side of the housing, wherein the inner clamp comprises two inner clamping pieces that are spaced and disposed opposite to each other, the first outer clamp comprises two first outer clamping pieces that are spaced and disposed opposite to each other, and the second outer clamp comprises two second outer claiming pieces disposed opposite to each other, and the insertion slot is formed between the two inner clamping pieces, wherein each of the first outer clamping pieces comprises a supporting arm, a first flexible arm, and a first contact segment, the supporting arm extends in an insertion direction of the insertion slot, the first flexible arm is formed by reversely bending one end that is of the supporting arm and that is close to the insertion opening towards an inner side of the insertion slot and extending the end in a direction away from the insertion opening, the first contact segment is disposed at one end that is of the first flexible arm and that is away from the insertion opening, one end that is of the supporting arm and that is away from the insertion opening is fastened in the housing, and the first contact segment is configured to press against the conductive surface of the plug, and wherein another segment of the second outer clamp is configured to press against the housing body and, after a point at which the another segment presses against the housing body, the second outer clamp is configured to taper away from the housing body in the insertion direction.

* * * * *